US005881842A

United States Patent [19]

Kikukawa

[11] Patent Number: 5,881,842

[45] Date of Patent: Mar. 16, 1999

[54] INDUSTRIAL VEHICLE

[75] Inventor: Keiichi Kikukawa, Kariya, Japan

[73] Assignee: Kabushiki Kaisha Toyoda Jidoshokki Seisakusho, Kariya, Japan

[21] Appl. No.: 741,214

[22] Filed: Oct. 29, 1996

[30] Foreign Application Priority Data

Oct. 31, 1995 [JP] Japan ..... 7-283947

[51] Int. Cl.[6] ..... B66F 9/06

[52] U.S. Cl. ..... 187/222; 280/756

[58] Field of Search ..... 187/222, 238, 187/233; 280/756, 727; 296/102, 104

[56] References Cited

U.S. PATENT DOCUMENTS

| | | | |
|---|---|---|---|
| 3,502,368 | 3/1970 | Maxa | 296/102 |
| 3,561,785 | 2/1971 | Kidder | 280/150 |
| 3,584,897 | 6/1971 | Frantz et al. | 280/150 C |
| 4,023,838 | 5/1977 | Sabec | 296/102 |
| 5,096,253 | 3/1992 | Jo et al. | 296/190 |

FOREIGN PATENT DOCUMENTS

| | | |
|---|---|---|
| 2099337 | 3/1972 | France . |
| 9407552 | 7/1994 | Germany . |
| 1125233 | 8/1989 | Japan . |
| 1226455 | 9/1989 | Japan . |

*Primary Examiner*—Kenneth Noland
*Attorney, Agent, or Firm*—Morgan & Finnegan L.L.P.

[57] ABSTRACT

A forklift has a mast pivotally connected to its front side. A pair of front pillars is disposed in the vicinity of the mast to extend rearward and upward. The front pillars define a cab in association with a pair of rear pillars. The front pillars are curved toward the mast and away from the cab so as to widen the space of the exit of the cab, which corresponds to the operator's torso.

9 Claims, 3 Drawing Sheets

INDUSTRIAL VEHICLE

BACKGROUND OF THE INVENTION

1. Field of the Invention

The present invention relates to industrial vehicles such as forklift trucks, and more particularly, to forklift trucks that are characterized by their front pillars, which support overhead guards.

2. Description of the Related Art

As shown in FIG. 4, a typical forklift truck has a mast 42 which is mounted on the front side of its body 41. A carriage 43 is connected to the mast 42. Forks 44 are supported by the carriage 43. The carriage 43 and the forks 44 are integrally raised and lowered with respect to the mast 42. The mast 42 is supported in a tiltable manner. A tilting cylinder 45 tilts the mast 42 between a vertical position, a forward tilting position, and a rearward tilting position.

Front pillars 47 and rear pillars 48 are provided at the front and rear side of a cab 46. An overhead guard 49 is supported above the cab 46 by the pillars 47, 48. The overhead guard 49 protects an operator, who sits on a seat 46*a*, from falling objects.

The front pillars 47 are linear and inclined so as not to interfere with the tilting of the mast 42. As illustrated by the double-dotted line in FIG. 4, there are types of forklift trucks having front pillars 47, the top section of which is curved. The front pillars 47 are made of square pipes. Headlights 50 and turn signals (not shown) are mounted on the front pillars 47. A grip 51 is also attached to the side surface of one of the front pillars 47.

As described above, the front pillars 47 extend upward from their lower ends and are inclined in a manner that lessens the space of the cab 46. This narrows the space through which the operator moves when getting on or off the forklift truck. In other words, the operator must avoid the front pillar 47 to get in or out of the cab 46. The narrow structure makes it difficult for the operator to get on or off the forklift truck. To solve this problem, the front pillars 47 may be arranged with a steeper inclination so that they extend only slightly inclined with respect to the vertical direction. However, the space required to mount the headlights 50 becomes insufficient when employing this structure.

As shown by the double-dotted line, the lower end of the front pillars 47 may be arranged at a more forward position to lessen the inclination of the pillars 47 while providing sufficient space for the operator. However, this structure consumes space at the front side of the pillars 47. Therefore, this structure may not be employed when there is not enough space in front of the pillars 47.

Additionally, although the grip 51 is provided on the front pillar 47 to assist the operator when getting on or off the forklift truck, the operator often grips the pillar 47 instead of the grip 51 when doing so. However, since the conventional front pillars 47 are made of square pipes, it is difficult for the operator to grip the pillar 47.

SUMMARY OF THE INVENTION

Accordingly, it is an objective of the present invention to provide an industrial vehicle which allows the operator to easily get on and off the vehicle while also enabling the mounting of parts.

It is another objective to provide an industrial vehicle having front pillars that may easily be gripped by an operator when getting on or off the vehicle.

A further objective of the present invention is to provide an industrial vehicle having an aesthetic appearance.

To achieve the above objectives, an improved industrial vehicle is proposed. The vehicle has a mast pivotally connected to the front of the vehicle, and a pair of front pillars located in the vicinity of the mast. Each of the front pillars is inclined such that it extends rearward and upward from the front of the vehicle to limit the size of the exit from the cab. The front pillars have a middle portion curved toward the mast and away from the cab.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

An embodiment of the present invention will hereafter be described with reference to FIGS. 1 to 3. The present invention is embodied in a battery forklift truck. However, the present invention is not limited to forklift trucks and may be embodied in other industrial vehicles.

Figure 1:
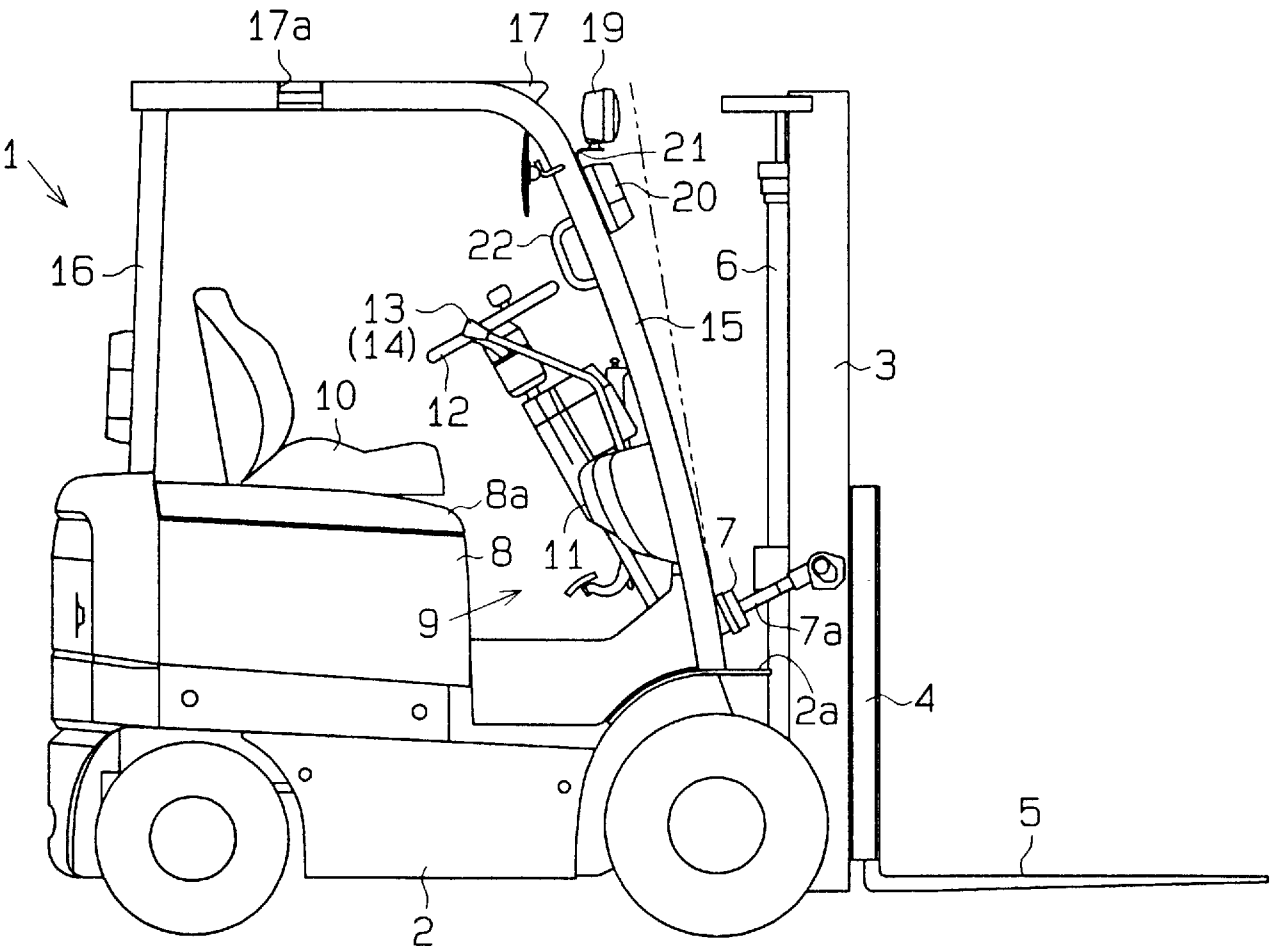
FIG. 1 is a side view showing an embodiment of a forklift truck according to the present invention.

As shown in FIG. 1, a forklift truck 1 has a mast 3 that is tiltably mounted on the front side of its body 2. A carriage 4 is connected to the mast 3. The carriage 4 may be raised and lowered with respect to the mast 3. Forks 5 are supported by the carriage 4 and move integrally with the carriage 4. The carriage 4 and the forks 5 are integrally raised and lowered with respect to the mast 3. The mast 3 includes an outer mast and an inner mast (not shown). A lifting cylinder 6 raises and lowers the inner mast. The carriage 4 moves integrally with the inner mast. The carriage 4 may also be moved with respect to the inner mast along the main mast. The mast 3 is connected to a piston rod 7*a* of a tilting cylinder 7. The tilting cylinder 7 tilts the mast 3 between a vertical position (the state shown in FIG. 1), a forward tilting position, and a rearward tilting position.

A cab 9 is defined in the body 2. A seat 10 is arranged on a lid 8*a* of a battery cover 8, in which a battery is accommodated. A panel 11 is provided at the front section of the cab 9. A steering wheel 12, a lift lever 13, and a tilt lever 14 are connected to the panel 11. The levers 13, 14 are maneuvered to raise and lower objects. In FIG. 1, the levers 13, 14 are shown in an overlapped state.

Front pillars 15 are provided at the front side of the cab 9 while rear pillars 16 are provided at the rear side of the cab 9. The pillars 15, 16 support an overhead guard 17 horizontally above the seat 10. The lower end of each front pillar 15 is welded to a frame 2*a* of the body 2. The front pillars 15 extend upwardly and are arched with respect to the cab 9. The upper parts of the front pillars 15 extend along the sides of the overhead guard 17.

Figure 2:
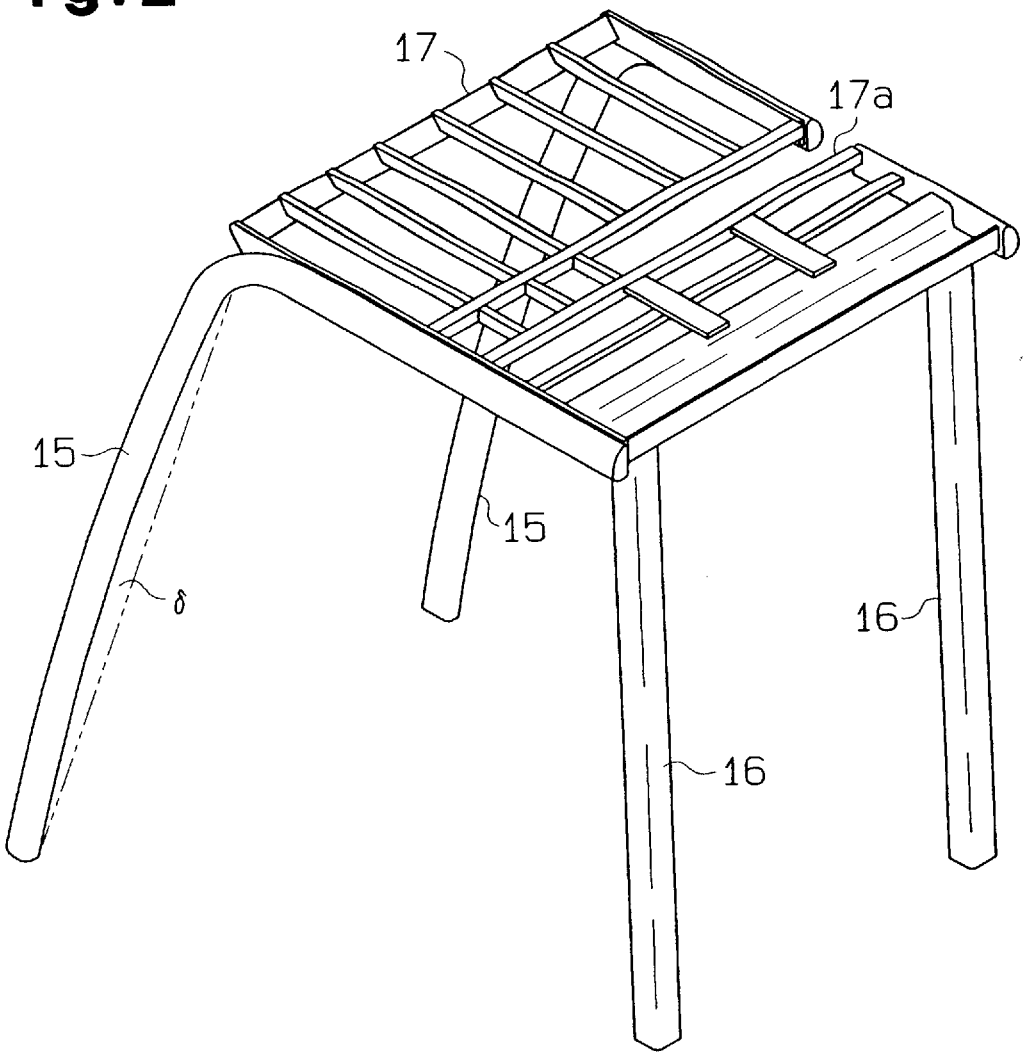
FIG. 2 is a schematic perspective view showing the supported state of an overhead guard.

As shown in FIG. 2, the overhead guard 17 is made of a rectangular frame with elongated rods extending therein in a grid-like manner. An opening 17*a* is provided at the right side of the overhead guard 17 to allow a cable connected to a hoist to be positioned above the lid 8*a* of the battery cover 8 when replacing the battery. Therefore, the left and right front pillars 15 are not identical. The left front pillar 15 extends continuously to the rear end of the overhead guard 17. The right front pillar 15 extends continuously toward the rear end of the overhead guard 17 until it reaches a location corresponding to the opening 17*a*. The rear end of the overhead guard 17 is welded to the upper ends of the rear pillars 16. The left and right sides of the overhead guard 17 are welded to the associated front pillars 15. This structure reinforces the entire overhead guard 17 despite the opening 17*a* provided therein.

The inclined front pillars 15 are arched outwardly toward the mast 3 from the cab 9. This widens the space corresponding to the operator's torso and makes it easier for the operator to get on and off the forklift truck 1. Furthermore, the arched front pillars 15 give an aesthetic soft appearance to the forklift truck 1.

The slight curving of each front pillar 15, towards the mast 3 and away from an imaginary line L extending between the upper and lower ends of the pillar, creates a space δ, as shown in FIG. 2. The space δ is easily obtained by curving each front pillar 15 so as to have a radius of curvature in the range of 4500 mm to 5000 mm, and more preferably, a radius of curvature of 4800 mm. The maximum width of the space δ differs depending on the type of the forklift truck. However, a maximum width of about ten centimeters (100 mm) may easily be obtained even for the smallest type of forklift trucks.

As shown in FIG. 1, a headlight 19 and a turn signal 20 are mounted on the front upper section of each pillar 15 by way of a bracket 21. The bracket 21 is secured to the inner surface, or flat surface 18*b*, (FIG. 3) of each pillar 15 by bolts. The headlight 19 and the turn signal 20 are fixed to the bracket 21. As shown in the double-dotted line in FIG. 1, if each arched front pillar 15 is straightened and arranged with a steeper inclination so that it extends only slightly tilted with respect to the vertical direction, the headlight 19 and the turn signal 20 may interfere with the tilting of the mast 3. However, since the front pillars 15 are curved to the rear in the present invention, the headlight 19 and the turn signal 20 may be mounted at substantially the same positions as in the prior art. This prevents the headlight 19 and the turn signal 20 from interfering with the tilting of the mast 3.

A grip 22 is attached to one of the front pillars 15. The grip 22 may be gripped by the operator when getting in or out of the cab 9.

Figure 3:
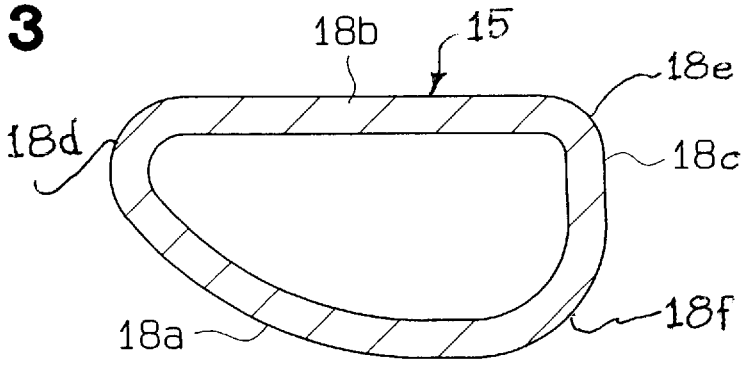
FIG. 3 is a cross-sectional view showing a front pillar.
Figure 4:
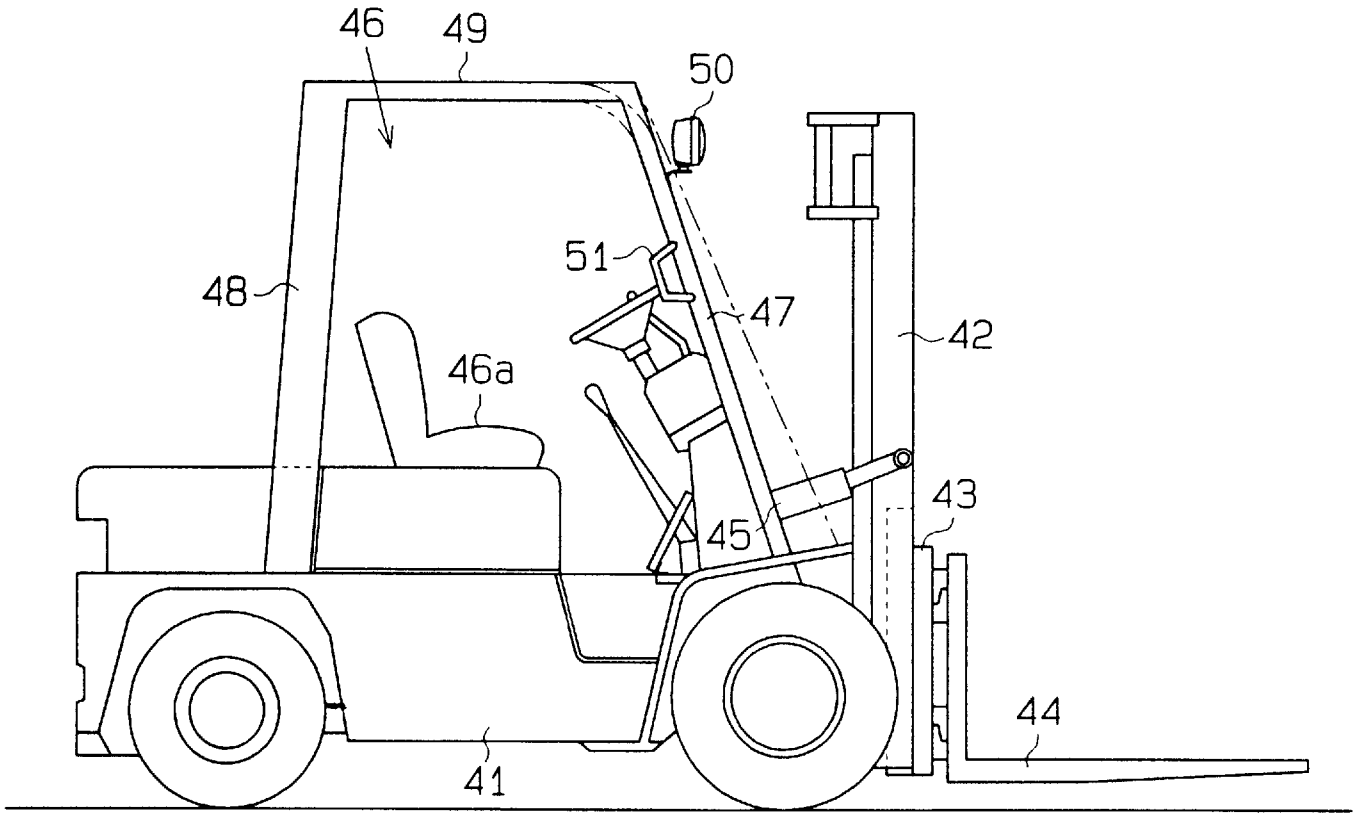
Fig. 4 (PRIOR ART)
FIG. 4 is a side view showing a prior art forklift truck.

As shown in the cross-sectional drawing of FIG. 3, each front pillar 15 has a generally oblong shape and is made of a pipe 18 having a convexly round surface 18*a*, which is defined at its outer side with respect to the cab 9, and a flat surface 18*b*, which is defined at its inner side. A flat rear side surface 18*c* extends perpendicularly outward from the flat inner side surface 18*b*, and the convexly round outer side surface 18*a* extends between the flat inner side surface 18*b* and the flat rear side surface 18*c*, as shown. Rounded corner edges 18*b*, 18*e* and 18*f* extend between the inner side surface 18*b* and the respective of its conjoining surfaces 18*a* and 18*c*, and between the rear side surface 18*c* and the outer side surface 18*a*, as also shown in FIG. 3. Thus, the outer side of each pillar 15 is non-symmetrical to its inner side. This structure allows the operator to easily grip the front pillar 15 when getting in or out of the cab 9. Furthermore, since the corners 18*d*, 18*e* and 18*f* are rounded outwardly, as shown in FIG. 3, angled corners are eliminated from the front pillars 15, objects are not as damaged when they come into contact with the pillars 15.

The flat surface 18*b* of each front pillar 15 enables parts such as the bracket 21 to be fixed thereto in a stable manner. In addition, the flat surface 18*b* is located at the inner side of the cab 9 and thus hides bolts, nuts, or the like that are used to mount parts such as the bracket 21. This improves the appearance of the forklift truck 1.

To move objects with the forklift truck 1, an operator sits on the seat 10 and maneuvers the steering wheel 12, the lift lever 13, and the tilt lever 14. An object is carried by the forks 5 and transported to a predetermined location.

Although only one embodiment of the present invention has been described herein, it should be apparent to those skilled in the art that the present invention may be embodied in many other specific forms without departing from the spirit or scope of the invention. More particularly, it should be understood that the above embodiment according to the present invention may be modified as described below.

The cross-section of each front pillar 15, which is constituted by a pipe 18, is not limited to the shape shown in FIG. 3. For example, the cross-section may be rectangular, circular, elliptical, semicircular, or the like in accordance with its application. Furthermore, the front pillars 15 need not be constituted by pipes. For example, the front pillars 15 may be constituted by a solid cylindrical bar.

The front pillars 15 and the overhead guard 17 may be fastened to each other by fasteners, such as bolts, instead of by welding.

In the above embodiment, the upper sections of the front pillars 15 are extended along the sides of the overhead guard 17. However, it is not required to extend the front pillars 15. The front pillars 15 may be provided in the same manner as the rear pillars 16 so that their top ends support the bottom surface of the overhead guard 17.

The rear pillars 16 are not necessarily required and may be excluded from the structure supporting the overhead guard 17. That is, the overhead guard 17 may be supported only by the front pillars 15.

Therefore, the present examples and embodiments are to be considered as illustrative and not restrictive and the invention is not to be limited to the details given herein, but may be modified within the scope of the appended claims.

What is claimed is:

1. An industrial vehicle for performing loading and unloading, the vehicle having a cab in which the operator sits, said vehicle comprising:

a mast pivotally connected to the front of the vehicle;

a pair of front pillars located in the vicinity of the mast, each of said front pillars being inclined such that it extends rearward and upward from the front of the vehicle to limit a size of an exit from the cab; and each of said front pillars having a middle portion curved toward the mast and away from the cab, wherein each of said front pillars has a radius of curvature in the range of 4500 mm to 5000 mm.

2. The industrial vehicle as set forth in claim 1, wherein each of said front pillars has a portion separated by at least 100 mm from an imaginary line intersecting its upper end and its lower end.

3. An industrial vehicle for performing loading and unloading, the vehicle having a cab in which the operator sits, said vehicle comprising:

a mast pivotally connected to the front of the vehicle;

a pair of front pillars located in the vicinity of the mast, each of said front pillars being inclined such that it extends rearward and upward from the front of the vehicle to limit a size of an exit from the cab;

each of said front pillars having a middle portion curved toward the mast and away from the cab; and a pair of rear pillars in association with the front pillars to limit the size of said exit from the cab, wherein each of said front pillars has a radius of curvature in the range of 4500 mm to 5000 mm.

4. The industrial vehicle as set forth in claim 3, wherein each of said front pillars has a portion separated by at least 100 mm from an imaginary line intersecting its upper end and its lower end.

5. The industrial vehicle as set forth in claim 4, wherein each of said front pillars has an oblong cross section.

6. The industrial vehicle as set forth in claim 5, wherein said vehicle includes the forklift.

7. The industrial vehicle as set forth in claim 6, wherein said forklift is actuated by a battery.

8. An industrial vehicle for performing loading and unloading, the vehicle having a cab in which the operator sits, said vehicle comprising:

a mast pivotally connected to the front of the vehicle;

a pair of front pillars located in the vicinity of the mast, each of said front pillars being inclined such that it extends rearward and upward from the front of the vehicle to limit a size of an exit from the cab; and each of said front pillars having a middle portion curved toward the mast and away from the cab, wherein each of said front pillars has an oblong cross-section including a flat inner side surface, a flat rear side surface extending perpendicularly outward from said flat inner side surface, and a convexly round outer surface extending between said flat inner side surface and said flat rear side surface.

9. The industrial vehicle set forth in claim 8, wherein said oblong cross-section of each of said front pillars further includes a rounded corner edge between each of said surfaces, respectively.

* * * * *